US010215396B2

(12) United States Patent
Willows et al.

(10) Patent No.: US 10,215,396 B2
(45) Date of Patent: Feb. 26, 2019

(54) ILLUMINATED BOTTLE SLEEVE AND MATING BOTTLE

(71) Applicant: Amphipod, Inc., Seattle, WA (US)

(72) Inventors: Keith S. Willows, Seattle, WA (US); June A. Angus, Seattle, WA (US); Antonio Del Rosario, Bellevue, WA (US)

(73) Assignee: Amphipod, Inc., Seattle, WA (US)

( * ) Notice: Subject to any disclaimer, the term of this patent is extended or adjusted under 35 U.S.C. 154(b) by 114 days.

(21) Appl. No.: 15/188,172

(22) Filed: Jun. 21, 2016

(65) Prior Publication Data

US 2017/0009979 A1 Jan. 12, 2017

Related U.S. Application Data

(60) Provisional application No. 62/231,603, filed on Jul. 10, 2015.

(51) Int. Cl.

| | |
|---|---|
| ***F21V 33/00*** | (2006.01) |
| ***A47G 23/02*** | (2006.01) |
| ***A45F 5/10*** | (2006.01) |
| ***A45F 5/00*** | (2006.01) |
| ***A45F 5/02*** | (2006.01) |

(52) U.S. Cl.

CPC ..... *F21V 33/0004* (2013.01); *A45F 5/00* (2013.01); *A45F 5/021* (2013.01); *A45F 5/10* (2013.01); *A47G 23/0241* (2013.01); *A45F 2005/1006* (2013.01); *A45F 2200/0583* (2013.01); *A47G 2200/08* (2013.01)

(58) Field of Classification Search

CPC .... F21V 33/0004; F21V 23/0414; A45F 5/00; A45F 2200/05; A47G 23/0241; A47G 2023/6058

See application file for complete search history.

(56) References Cited

U.S. PATENT DOCUMENTS

| | | | | |
|---|---|---|---|---|
| 6,073,796 A * | 6/2000 | Mogil | ..... | A45F 3/16 215/12.1 |
| 6,158,870 A * | 12/2000 | Ramirez | ..... | A61J 9/0607 215/11.1 |
| 7,465,058 B1 * | 12/2008 | Lopez | ..... | A47G 23/0241 362/101 |
| 2007/0017924 A1 * | 1/2007 | Hundley | ..... | B65D 81/3876 220/737 |

* cited by examiner

*Primary Examiner* — Karabi Guharay
(74) *Attorney, Agent, or Firm* — Lowe Graham Jones PLLC

(57) ABSTRACT

A sleeve for use with a mating bottle forms a tubular shape having a top end and a bottom end and an interior space within the tubular shape formed by the sleeve. A light source is carried on the sleeve, the light source being oriented to direct the majority of the light emitted from the light source toward the interior space. One or more holes formed in the sleeve, preferably as a pattern, such that light emitted from the light source and directed toward the interior space is allowed to pass through the one or more holes when the sleeve is attached around the bottle.

22 Claims, 17 Drawing Sheets

ILLUMINATED BOTTLE SLEEVE AND MATING BOTTLE

PRIORITY CLAIM

This application claims the benefit of U.S. Provisional Application No. 62/231,603, filed Jul. 10, 2015, the contents of which are incorporated by reference.

FIELD OF THE INVENTION

This invention relates generally to bottles and sleeves for bottles, particularly including a light or source of illumination.

SUMMARY OF THE INVENTION

The preferred implementation of the invention creates an illumination device particularly useful for outdoor sports wherein both illumination and the ability to carry fluids are desired. A bottle with integrated illumination allows ready-access to fluids as desired as well as a remarkable flashing multi-colored, single-colored, or white strobe, with optional blinking, continuous, twinkling or other effects as may be desired, particularly for use in low light conditions while engaging in sports like running, biking, and many outdoor activities.

In one version, a sleeve is manufactured from neoprene or other sheet material of appropriate thickness (as commonly used in wetsuits), and is preferably die-cut or otherwise shaped.

Further, the material may be laminated on one or both faces with other sheet material which is preferably fabric such as Tricot Nylon®, Spandex®, or Lycra®, and which most preferably is a stretch fabric. In yet other versions the material comprises one layer or is otherwise not laminated, and in some versions the material is not flexible.

The sheet material in some examples ranges from 1 mm or less, to 4 mm or more depending on the desired bottle insulation, mechanical attributes, or other desired functions.

In some versions, the material may be printed, stickered/decaled, silk-screened, coated, painted, or otherwise clad with a thin layer of material that adds visual appeal and may also add strength, durability, reflectivity or serve other useful functions.

In some versions, the sleeve is molded as one piece, with optional through-holes molded in place.

In some examples, the sleeve is created by utilizing one or more of several different manufacturing processes, and may be injection molded, pressure formed or otherwise formed such that the desired shape, geometry, structure, and durability, are created. In some cases it may be desirable to manufacture the sleeve by casting, injection molding or otherwise molding or forming.

A thin layer of material is optionally added or laminated using any of a number of techniques such as in-mold transfer, gluing, heat lamination, silk screening, dipping, or others, in order to create a surface texture, desired reflective surface, or add strength.

BRIEF DESCRIPTION OF THE DRAWINGS

Preferred and alternative examples of the present invention are described in detail below with reference to the following drawings:

FIG. 11 shows a preferred LED assembly position and angle wherein the LED is shown pointing downward at an angle of approximately 45 degrees with respect to a plane defined by the circuit board, such that the focal beam of the LED points and travels in a preferable "light scatter" path as shown in FIG. 28*c*.

DETAILED DESCRIPTION OF THE PREFERRED EMBODIMENT

In accordance with some of the preferred aspects of the invention, a confluence of disclosed geometry, construction, materials and features can provide a bottle with a striking lighting effect. At the same time, most versions of the invention are easy to manufacture. It can be constructed using inexpensive and easily obtained materials, assembled using conventional manufacturing equipment, produced relatively easily and inexpensively as well as with light and comfortable readily available materials giving an aesthetically pleasing highly functional, versatile solution for its desired purpose.

Figure 1:
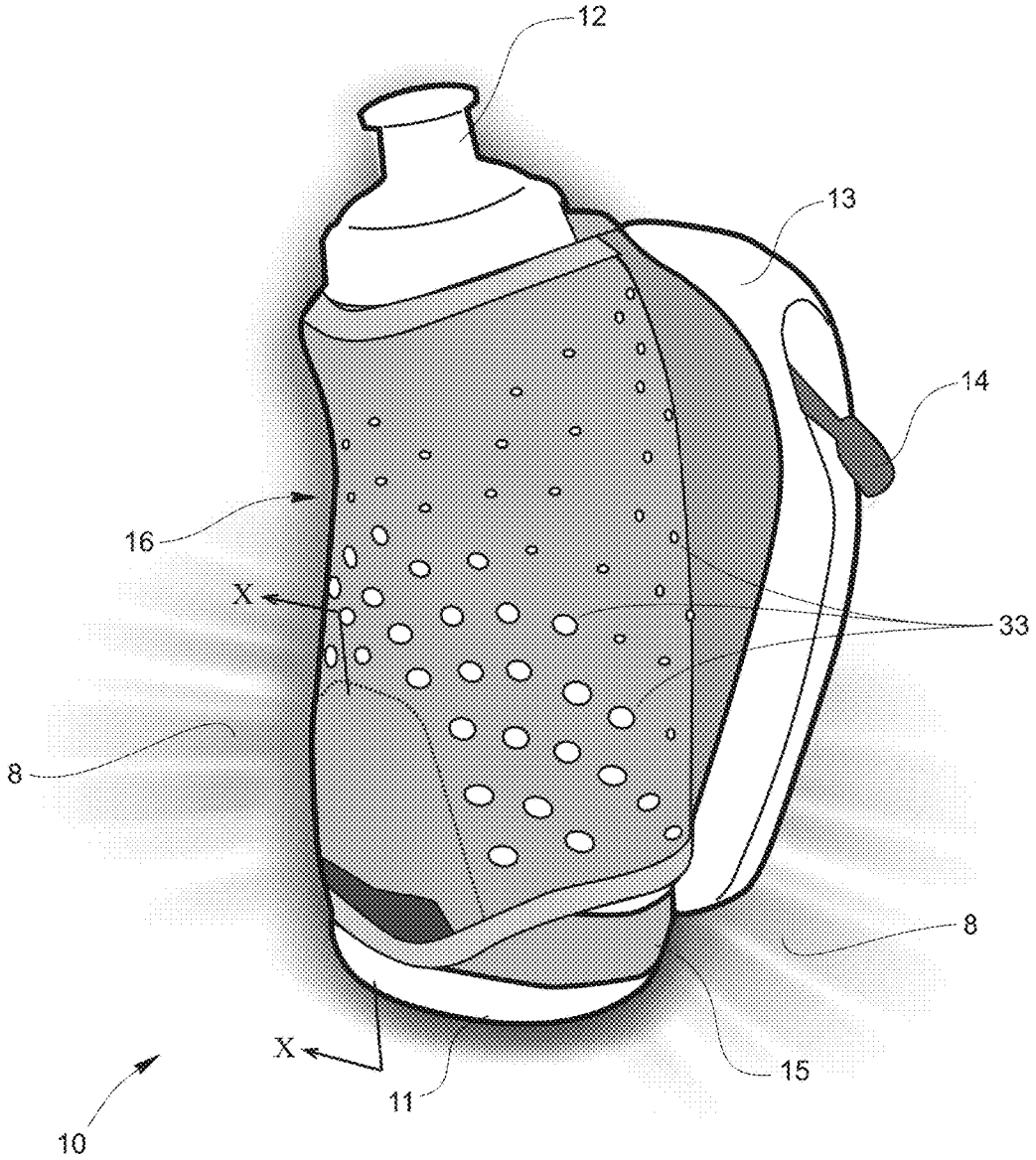
FIG. 1 is a front three-quarter perspective view of a preferred embodiment of the invention 10, including a sleeve 16, cap 12, bottle 11, and optional hand strap pouch 13 with zipper pull 14, and a lower strap 15 for the hand strap. Light 8 is indicated as illuminating from the bottle, particularly through the sleeve.
Figure 8:
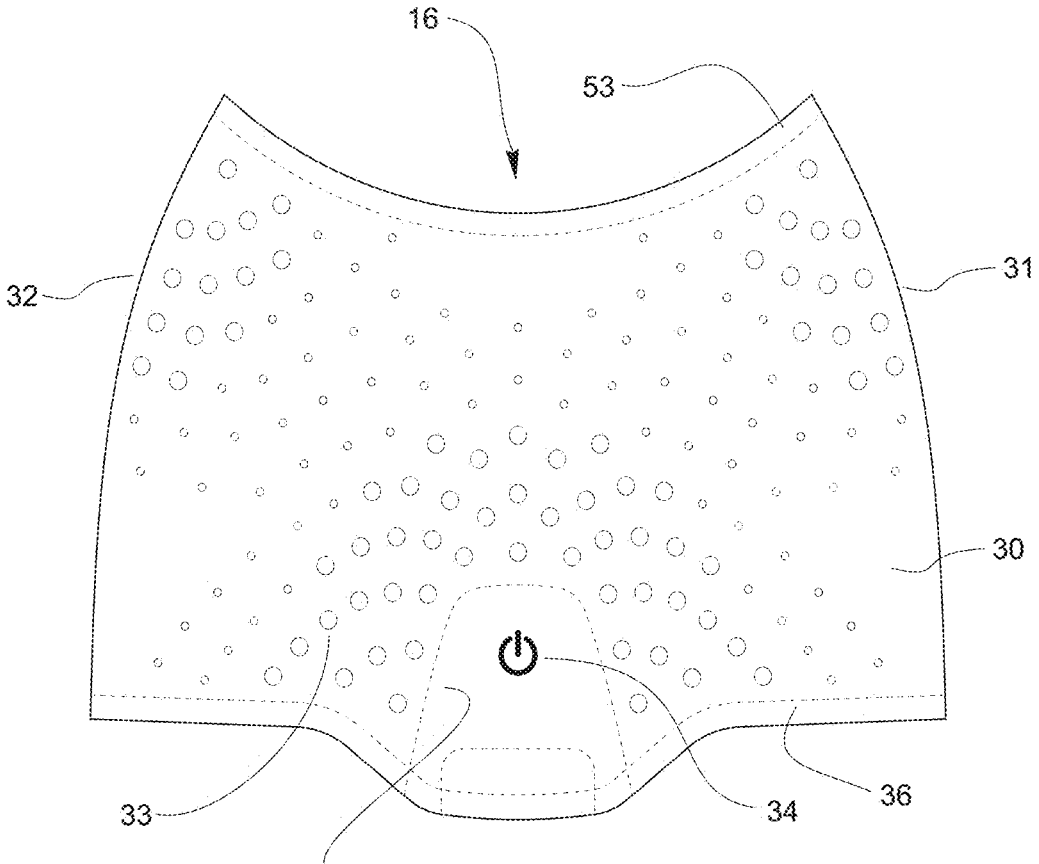
FIG. 8 is a front plan view of preferred sleeve 16, illustrated in a flat configuration before being joined (for example, by stitching, gluing, etc.) together along seams or edges 31 and 32 such as illustrated in FIG. 10. A preferred pattern of holes 33 are cut, punched, or otherwise formed in the material. An exemplary logo or indicator 34, preferably silk screened or otherwise applied, and in the form of a power symbol, is illustrated. A preferred stitch line 35 (to be joined with a corresponding stitch 38 shown in FIG. 9) denotes a location for a clear window 37 (see FIG. 9) creating an envelope to an electronic LED circuitry and battery.

With reference to FIG. 1, a preferred bottle with sleeve 10 includes a sleeve 16 which is preferably formed by die-cutting a sheet of neoprene, most preferably in the shape as shown in FIG. 8. In some versions, the neoprene sheet includes a laminated face fabric (preferably Tricot Nylon®, Spandex®, or Lycra®), preferably on both the inside 41 and outside 30 surfaces of the sleeve (see FIG. 10). The inside surface more preferably is formed with a highly reflective surface (preferably is a bright color like white, a bright neon color, reflective silver or a reflective surface), with the reflective surface directed inward, toward the interior of the bottle, thereby reflecting light striking the surface back into the bottle.

Figure 11:
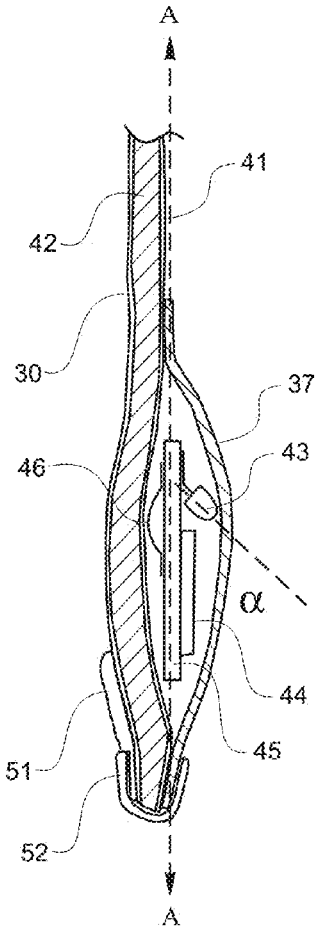
FIG. 11 is a sectional view taken through section A-A of FIG. 10, showing an exterior face fabric (or material) 30, interior face fabric or material 41, neoprene or other internal material 42, clear window sheet 37, LED or other light 43, battery or other power source 44, circuit board 45, switch 46, logo tag 51, and edging or edge binding 52.

With reference to the version as illustrated in the sectional view of FIG. 11, the interior 41 is shown in cross section. In some examples, it is desirable for this face fabric to be a white color such that the light from the LED lights this interior surface and the illuminated white interior of the sleeve will tend to give the bottle 11 a remarkable glowing effect, producing light rays 9, which emanates through the bottom, top and holes (if any) formed in the sleeve.

It is desirable for both cap 12 and bottle 11 to be made of a transparent or translucent material, preferably with the bottle having a more frosted or slightly milky or translucent appearance such that when the LED or LEDs 43 are illuminated this light passes through the bottle wall and then illuminates the interior much like a candle would illuminate a tissue paper sky lantern, thereby creating a remarkable glowing orb look. The cap is preferably highly transparent or at least translucent such that as much light as possible is allowed to pass through to create a bright visual effect.

Further it may be desirable for both the cap and bottle to be made of a tinted colored material and thus a colored glow can be attained. In most cases it is preferable for the bottle to be translucent/frosted with a similar material look of a natural HDPE (high density polyethylene) milk jug and the cap having more transparency, much like natural high transparency polypropylene, such that when a colored LED is used (such as a red, blue or green LED or multiple LEDs of different colors are used) the color of the glowing bottle is bright and clear and can change with the color of the particular LED that is illuminated. The translucency of the bottle material such as found with natural HDPE used in common milk jugs also serves to diffuse the light passing through it not only emanating out from the bottle but also as the light passes from the LED bulb itself through the wall of the bottle to the interior space of the bottle wherein the intensity of the somewhat point-source LED light is diffused further which further creates the remarkable glowing "orb" bottle look.

As noted above, a preferred sleeve that houses the LED and circuitry is faced with a reflective interior surface as described above, and further the sleeve has optional through holes 33 of large enough size to emit a desirable amount of light. The holes are most preferably spaced such that the internal reflective surface is effective at reflecting and diffusing some of the light from LED or LEDs. Accordingly, the glowing "orb" look is enhanced by the contrast of the light passing through the holes while the sleeve contains, diffuses, and reflects some of the light.

Figure 3:
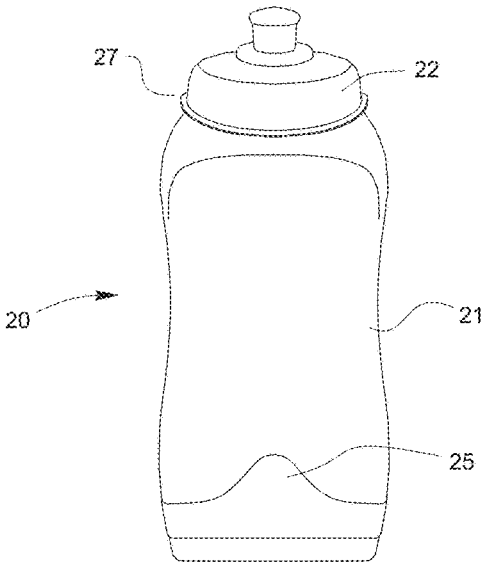
FIG. 3 is a front view of a preferred embodiment of a hand strap combined with a preferred bottle, in which a sleeve is not shown in order to simplify the illustration of the bottle and hand strap.
Figure 4:
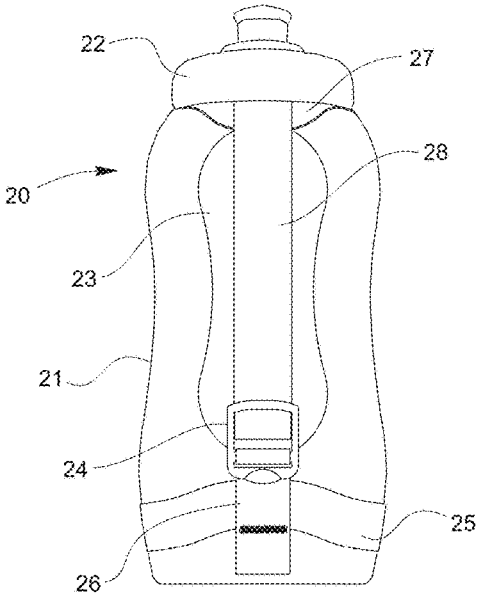
FIG. 4 is a back view of the combined bottle with hand strap as shown in FIG. 3, including a bottle 21, cap 22, hand strap pad 23, strap adjuster 24, bottom bottle gripping strap 25, hand strap size adjustment strap 26 and bottle collar 27.
Figure 5:
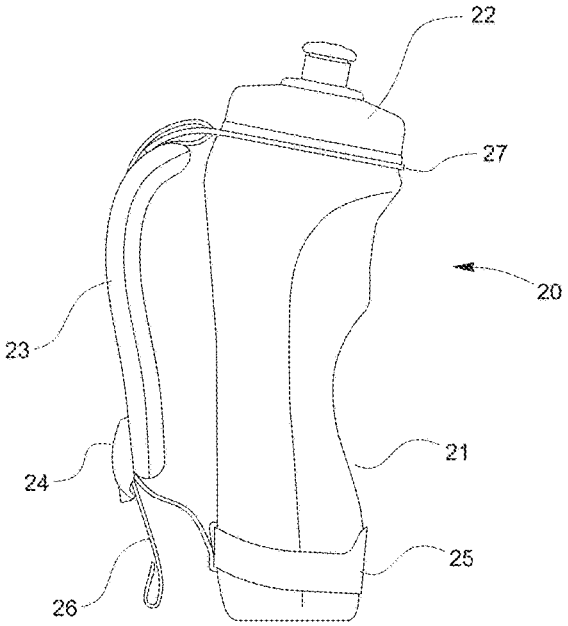
FIG. 5 is a side view of the embodiment shown in FIG. 3.

An optional hand strap pouch 13 with zipper pull 14 can be provided such that a user can carry keys, ID, or other items in the pouch attached to a strap. The version of FIGS. 3 through 7 illustrates a strap configured without a pouch. Strap padding 23, as shown in FIG. 4, may be used instead of (or in addition to) a pouch. A lower strap 15 secures the hand strap to the bottle, and is a preferably a loop of hypalon sized such that it holds hand strap to the bottom of the bottle tightly. As seen in FIGS. 3-5, an optional version of the lower strap 25 is best illustrated, attaching a hand strap without an accompanying hand strap pouch.

Figure 2:
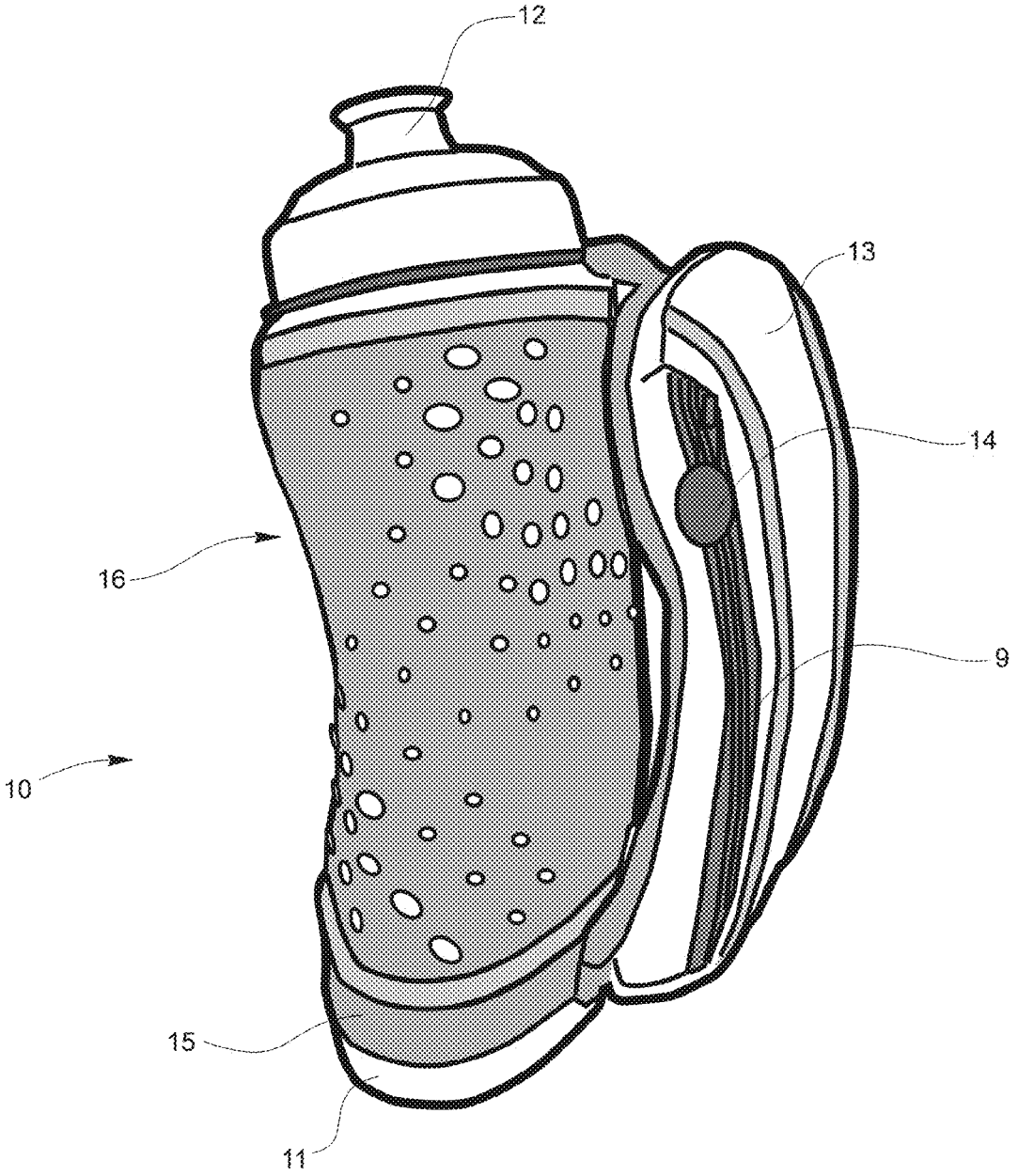
FIG. 2 is a back perspective view of a preferred combined bottle and sleeve 10.

FIG. 2 is a back perspective view of a combined bottle and sleeve 10, comprising a bottle 11 and sleeve 16, showing the optional hand strap pouch 13, including a zipper 9 to access the optional pouch. The hand strap pouch is preferably formed of nylon or other fabrics commonly used in industry. The lower strap 15 attaches the hand strap pouch to the bottle at the lower end.

FIG. 3 is a front view of a preferred embodiment of a combined hand strap and bottle 20, although the hand strap is not visible because it is behind the bottle 21. A sleeve is not illustrated in this version, either because the sleeve is not used in the version as illustrated, or to remove the sleeve for simplicity of describing the combined bottle and hand strap. As shown, a combined bottle with hand strap 20 includes a bottom bottle gripping strap 25 which is preferably formed from a loop of hypalon, webbing, strapping or other materials. The hand strap secures to the bottle at an upper end via a collar ring 27 adjacent the cap 22.

FIG. 4 is a back view showing a preferred embodiment of a hand strap combined with a preferable bottle as shown in the front view of FIG. 3, and for the same reasons the sleeve is not shown. The bottle with hand strap in combination 20 includes a bottle 21 which is preferably formed (for example, blow molded) from highly translucent low density polyethylene or other materials (such as HDPE, PP, Tritan, PETE, or others). A cap 22 is preferably injection molded or otherwise formed from high transparency polypropylene (PP) but can alternatively be made of translucent HDPE, LDPE or other plastics. It is generally preferable for the cap to be close to transparent or very translucent. A hand strap pad 23 is preferably made of soft cushioned fabric and is preferably connected to a collar ring 27 by a length of strapping. In one version, the collar ring 27 is die cut from a polypropylene flexible plastic sheet and is cut in a shape, with a hole large enough to fit over the neck of the bottle and is held in place by the cap 22. A strap adjuster 24 is formed from injection molded plastic, and in one version is a triglide-type adjuster fastened to the hand strap pad 23 via a length of webbing 28. The strap adjuster is joined to an adjustment strap 26, which is preferably a length of webbing attached to loop 25 (preferably a loop of hypalon or webbing), which is sized to fit snugly around the bottom of the bottle 21.

FIG. 5 is a side view of the embodiment shown in FIG. 3. As shown, the collar ring 27 fits under the cap 22 and is placed on the threaded portion of the neck of the bottle so that the cap holds the collar ring 27 in place. A tap portion of the collar ring 27 preferably extends outward beyond the cap and this extension preferably has a slot which allows for connection to strap portion 28.

Figure 6:
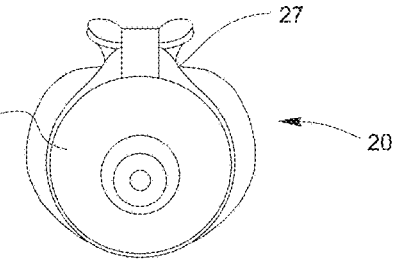
FIG. 6 is a top view of the embodiment shown in FIG. 3.

FIG. 6 is a top view of the embodiment shown in FIG. 3. The extension of the ring 27 can be seen in this view extending out from under the cap 22.

Figure 7:
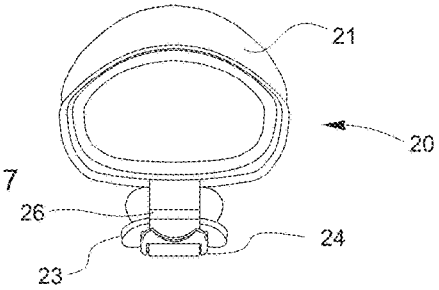
FIG. 7 is a bottom view of the embodiment shown in FIG. 3.

FIG. 7 is a bottom view of the embodiment shown in FIG. 3.

Figure 10:
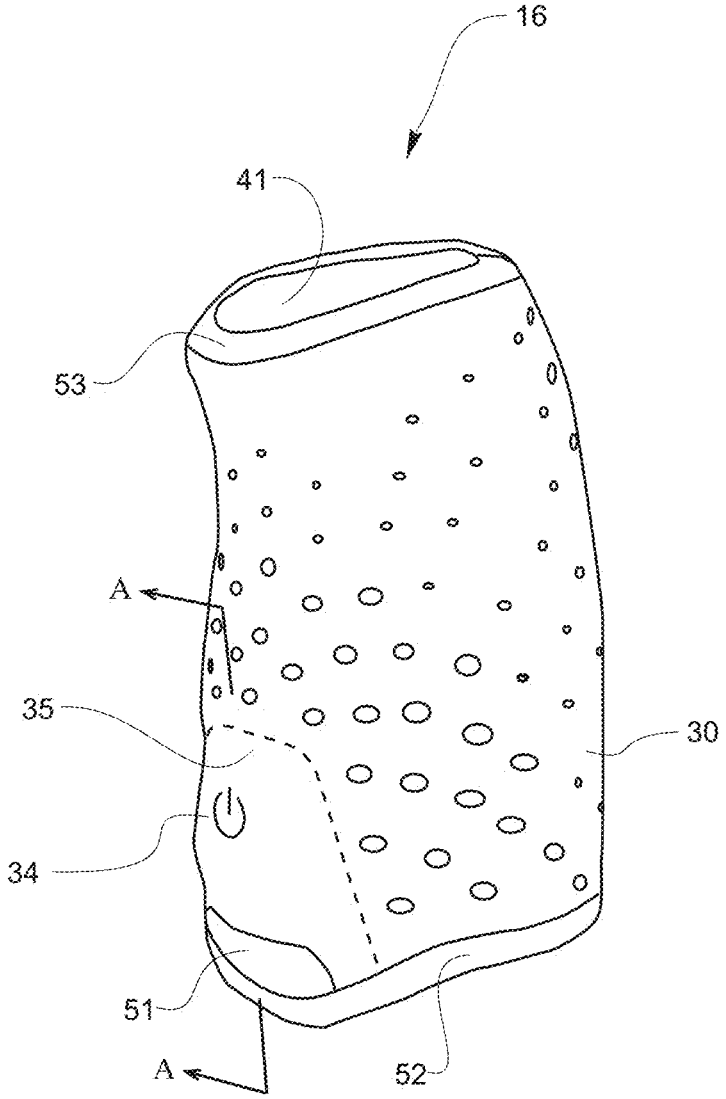
FIG. 10 shows a front three-quarter perspective view of a preferred sleeve 16, having an optional logo tag 51. An exterior surface face fabric 30 and interior surface face fabric 41 are indicated, and most preferably a neoprene sheet is sandwiched between interior and exterior face fabrics 30 and 41.

FIG. 8 is a front plan view of a version of a sleeve 16, shown in a flat configuration before it has been sewn or otherwise joined together along seams or edges 31, 32. FIG. 10 shows the sleeve 16 in its assembled form with the edges 31, 32 fastened together (by stitching, gluing, riveting, or otherwise fastening) such that a tube or sleeve shape is formed.

A number of holes (e.g., 33) are punched or otherwise formed or cut into the swatch of material forming the sleeve to produce a hole pattern such as shown through the sleeve 16. In one version the hole sizes range from approximately 2 to approximately 8 millimeters in diameter depending on the desired look, although holes could be smaller or larger depending on the desired look. It should be noted that because the sleeve may be stretched onto the bottle such that a snug fit is attained, the holes may stretch larger or change size and shape slightly.

Figure 46:
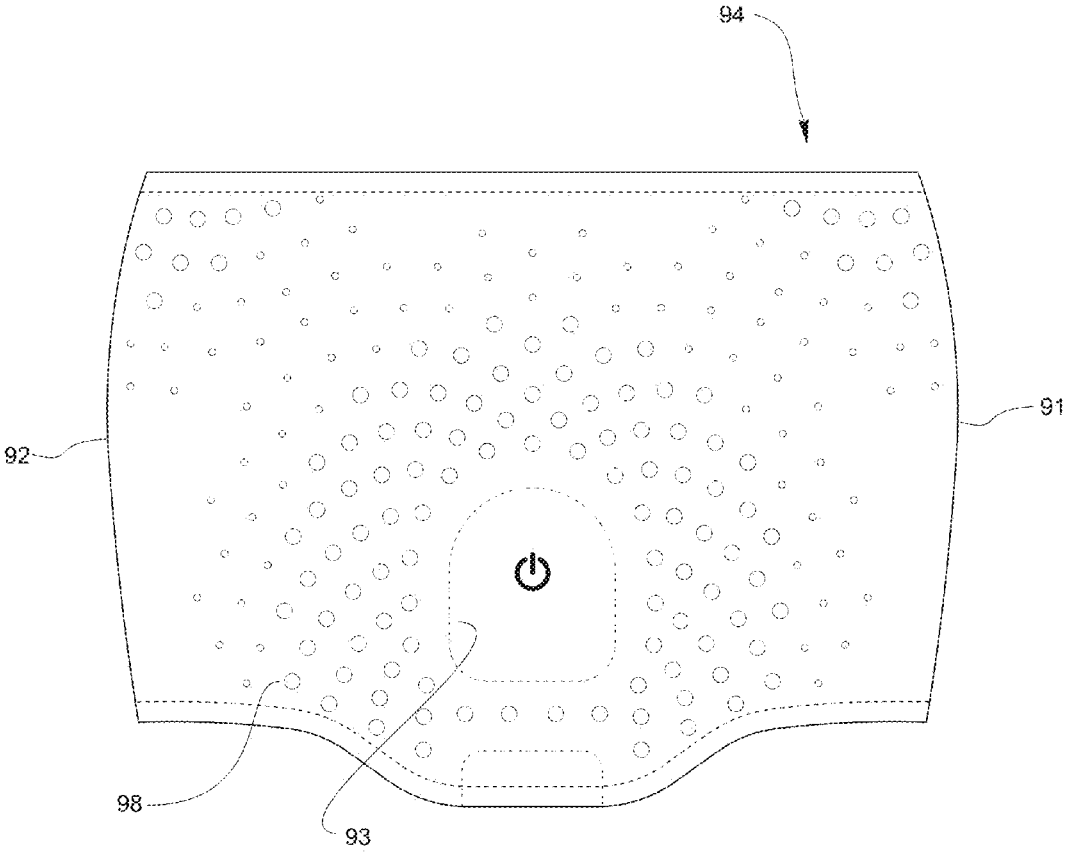
FIG. 46 is a front plan view of an alter a e sleeve 94, shown flat before it has been joined together along seams or edges 91 and 92 such that a tube or sleeve shape is formed similar to the sleeve embodiment shown in FIG. 10. The sleeve includes a preferred hole pattern and a silk screened or otherwise applied power symbol, positioned to overly a power switch associated with the LED circuit as described above.

The hole pattern can be changed to suit a particular need or desire. For example a pattern forming a logo shape can be punched in the sleeve if desired or other shapes and patterns can be punched. The radial patterns shown in FIG. 8 and FIG. 46 are highly desirable and create a remarkable effect. This overall effect can be tuned to get varying effects with hole location, size, placement, and spacing; the location, number, angle, and color of the LED(s); the color of the window 37 and bottle; and the sleeve inner facing fabric color and reflectivity.

A power symbol 34 is silk-screened or otherwise applied, denoting a position on which a user would press to activate a switch to turn the illuminating function on or off.

A stitch line 35 on the sleeve 16 mates with a corresponding stitch line 38 on a clear plastic window 37 (see FIG. 9) such that an envelope can be created to house the electronic LED circuitry/battery. Preferably the window 37 is a die-cut clear or translucent vinyl or TPE, but it may be desired in some cases to tint the window 37 such that it imparts a color to the light passing through from the LED(s).

Figure 9:
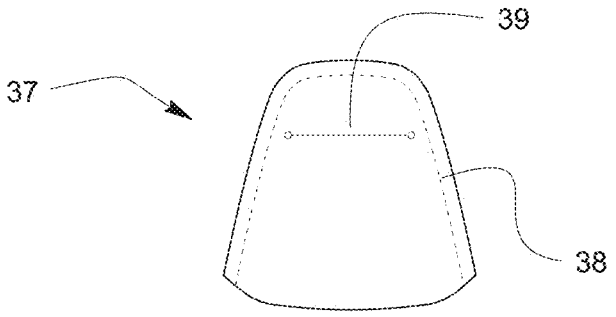
FIG. 9 shows a preferred shape for a die-cut or otherwise formed window (such as from clear vinyl, thermoplastic elastomer (TPE) or other materials), preferably having a slit 39 for a user or assembler to access the electronic LED circuitry and battery in the resulting pouch, such as the circuit shown in FIG. 20 and FIG. 21.
Figure 20:
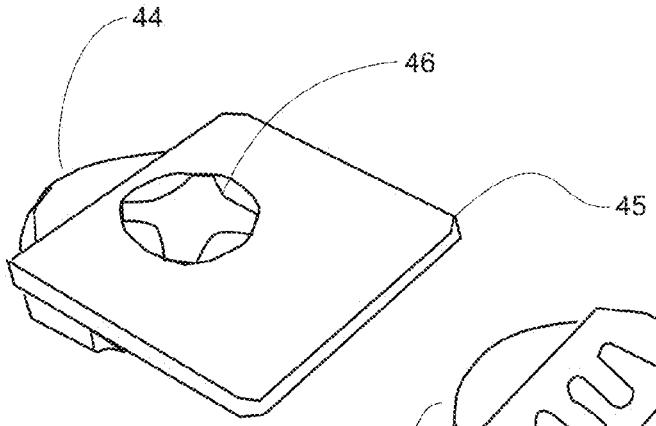
FIG. 20 is a front perspective view of a preferred LED circuit assembly, with a circuit board 45 and switch 46.
Figure 21:
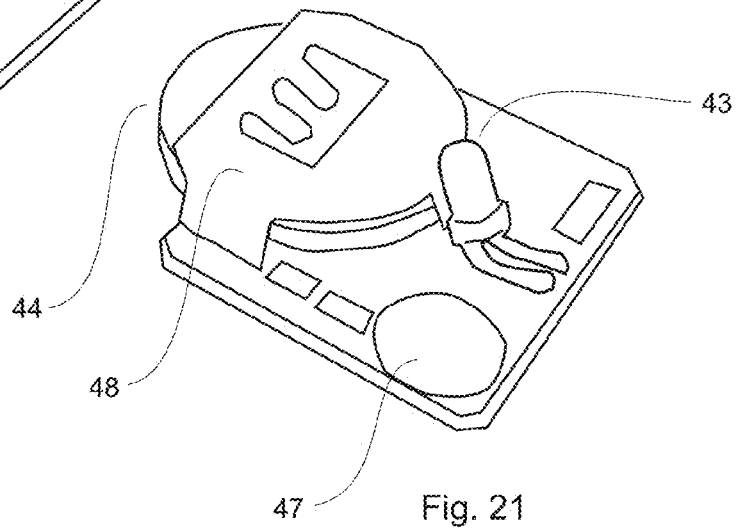
FIG. 21 is a rear perspective view of an LED circuit assembly 43, showing an integrated circuit (IC) 47 for controlling the LED, a battery holder/housing 48, and a battery 44.

FIG. 9 shows a clear flexible vinyl, thermoplastic elastomer (TPE) window 37 with a slit 39 that enables a user or assembler to access the electronic LED circuitry/battery, an example of circuitry shown in FIG. 20 and FIG. 21. The stitch line 38 denotes where the window 37 would be stitched to sleeve 16, forming a pocket together with edging stitch line 36 (shown in FIG. 8). As mentioned, the window 37 can be tinted as desired to get a specific lighting effect.

FIG. 10 shows a front perspective view of a preferred sleeve 16 in its assembled form (and not attached to a bottle), in this case including a logo tag 51. In this example, an exterior surface face fabric 30 and interior surface face fabric 41 are also included. The sleeve may comprise a support layer such as a neoprene sheet, which is sandwiched between the face fabrics 30 and 41, each of which may be laminated to the neoprene base layer. Neck area edge binding 53 and bottom edge binding 52 are attached, preferably in the form of stretch Tricot Nylon®, Spandex®, or Lycra®, or other materials. The bottom binding 52 preferably not only binds the bottom edge of the sleeve but also preferably closes off the bottom edge of the pocket formed by window 37 and sleeve 16, as can be seen in cross section in FIG. 11.

FIG. 11 is a section view through section A-A of FIG. 10, illustrating the exterior face fabric 30, interior face fabric 41, neoprene base layer clear window sheet 37, LED (or light source) 43, battery or power source 44, circuit board 45, switch 46, logo 51, and edging or binding 52. FIG. 11 shows an LED assembly position and angle wherein the preferable LED is pointing downward (that is, toward the bottom of the bottle) and inward (that is, toward the interior of the bottle) at an angle $\alpha$ of about 45 degrees with respect to an axis A-A shown in FIG. 11, in which the axis A-A extends substantially vertically from the bottom of the bottle to the top of the bottle when the bottle is resting on a horizontal surface such as a countertop. Likewise, the axis A-A will be substantially parallel with the bottle sidewalk in most cases, though as shown in the preferred embodiment "substantially" vertically accounts for some undulations and slight inward or outward inclinations in an otherwise vertically extending sidewall. With the 45 degree orientation as shown, the focal beam of the LED points and travels in a path as shown in FIG. 28*c*. Further it can be seen from FIG. 11 how a button or switch 46 on the circuit board 45 can be actuated by pressing on the flexible neoprene 42 in the appropriate location. Further, the LED 43 is protected from damage in the position of FIG. 11, but comparatively less protected in the position of FIG. 13.

In some versions, the laminated interior face fabric 41 is a reflective or bright material such that this surface acts to reflect and diffuse light. A preferable material for the face fabric 41 is a bright white Tricot Nylon®, Spandex®, or Lycra®, or alternatively a reflective silver other highly or somewhat reflective fabric. In some cases it may be desirable to eliminate the interior face fabric 41. In such cases it may be desirable to use white neoprene or other white or light colored material similar to neoprene to produce a similar reflective or diffusive effect.

Figure 12:
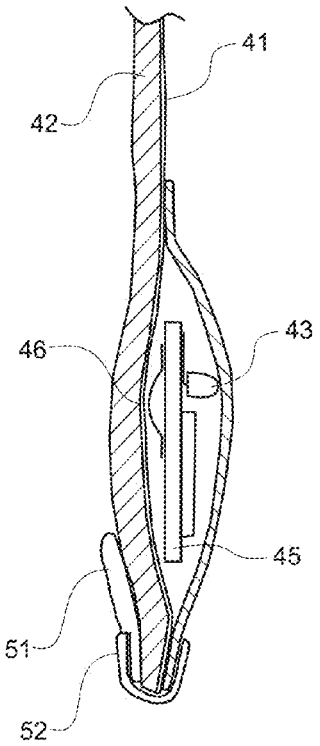
FIG. 12 is a sectional view through section A-A of FIG. 10 showing an alternate LED position/angle, creating an LED light scatter path as shown in FIG. 29.
Figure 29:
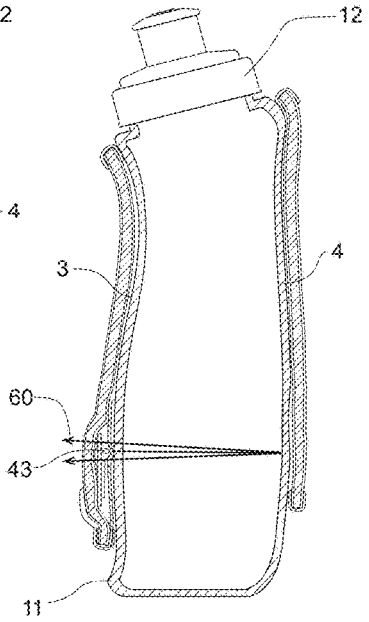
FIG. 29 is a section view through section D-D of FIG. 28*a*, showing an alternate position for an LED 43 and resulting approximate LED light focal scatter path 60.

FIG. 12 is a section view through section A-A of FIG. 10 showing an alternate LED position and angle wherein the resulting approximate LED light focal path is shown in FIG. 29. In this case, the angle is at approximately 90 degrees. FIG. 12 also shows a version without an exterior face fabric.

Figure 13:
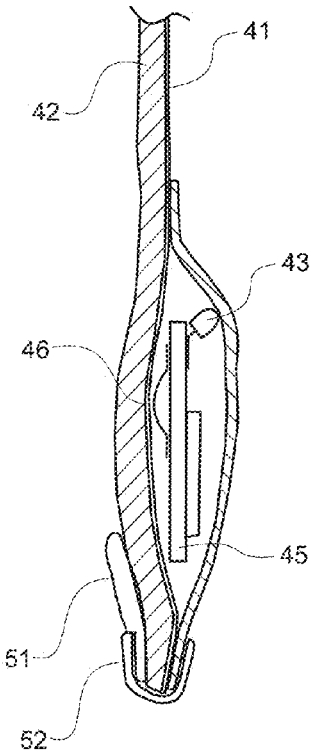
FIG. 13 is a sectional view through section A-A of FIG. 10 showing an alternate LED position/angle, creating an LED light scatter path as shown in FIG. 30.
Figure 30:
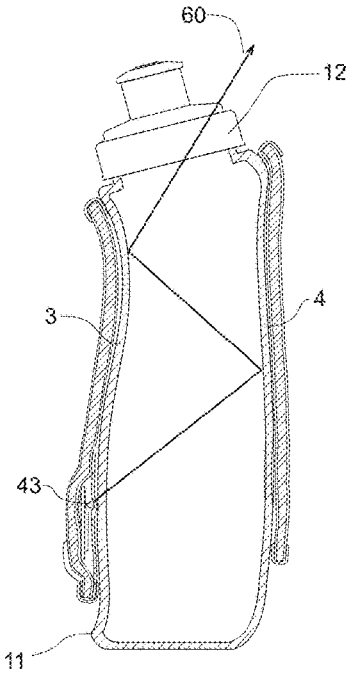
FIG. 30 is a section view through section D-D of FIG. 28*a*, showing an alternate position for an LED 43 and resulting approximate LED light focal scatter path 60.

FIG. 13 is a section view through section A-A of FIG. 10 showing another alternate LED position and angle wherein the resulting approximate LED light focal path is shown in FIG. 30. In this case, the angle is upward, at an angle of about 135 degrees.

Figure 14:
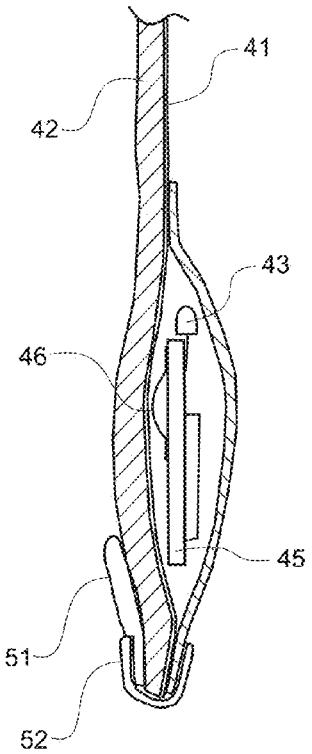
FIG. 14 is a sectional view through section A-A of FIG. 10 showing an alternate LED position/angle.

FIG. 14 is a section view through section A-A of FIG. 10 showing yet another alternate LED configuration, and in this case the LED is directed straight upward, such that the angle of the LED is at about 180 degrees, or parallel with the axis A-A.

Figure 15:
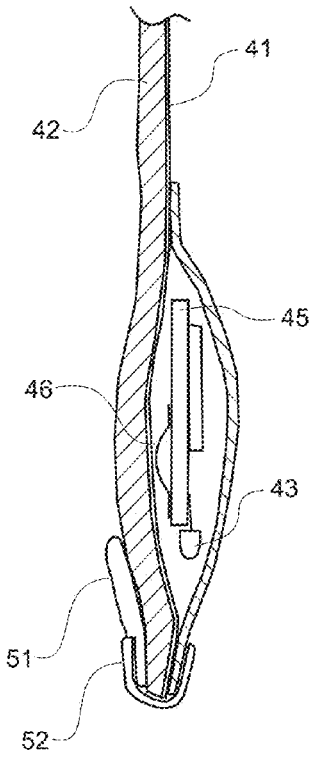
FIG. 15 is a sectional view through section A-A of FIG. 10 showing an alternate LED position/angle.

FIG. 15 is a section view through section A-A of FIG. 10 showing another alternate LED configuration, in this case directed downward at zero degrees.

Figure 16:
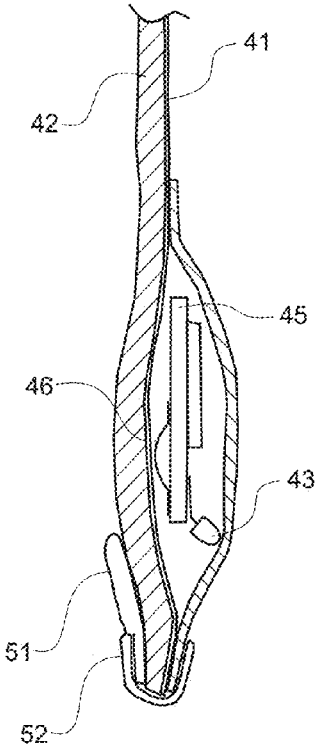
FIG. 16 is a sectional view through section A-A of FIG. 10 showing an alternate LED position/angle.

FIG. 16 is a section view through section A-A of FIG. 10 showing another alternate LED configuration. In the case of FIG. 16, the LED is moved to a lower position on the circuit board.

Figure 17:
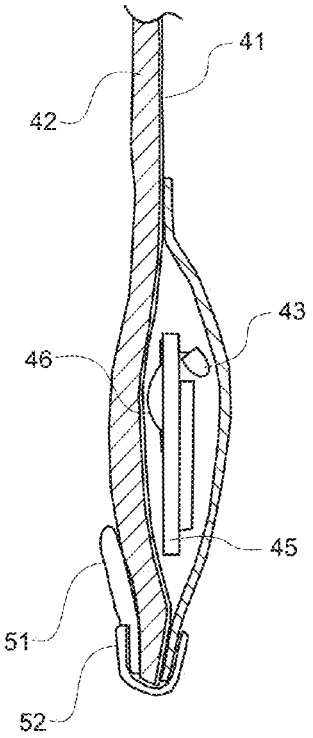
FIG. 17 is a sectional view through section A-A of FIG. 10 showing an alternate LED position/angle.

FIG. 17 is a section view through sec ion A-A of FIG. 10 showing another alternate LED configuration.

Figure 18:
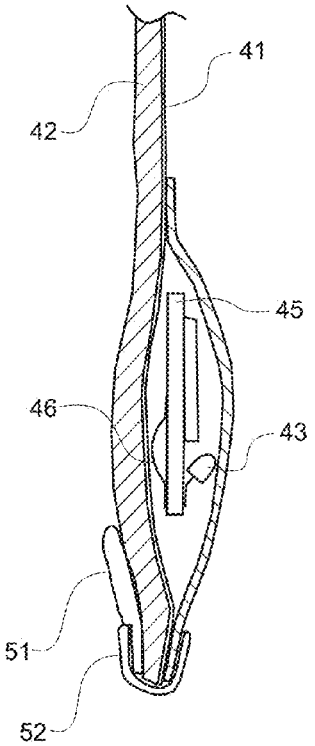
FIG. 18 is a sectional view through section A-A of FIG. 10 showing an alternate LED position/angle.

FIG. 18 is a section view through section A-A of FIG. 10 showing another alternate LED configuration.

Figure 19:
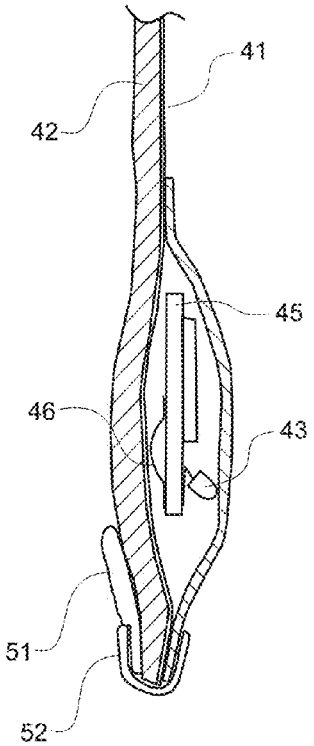
FIG. 19 is a sectional view through section A-A of FIG. 10 showing an alternate LED position/angle.

FIG. 19 is a section view through section A-A of FIG. 10 showing another alternate LED configuration.

FIG. 20 is a front perspective view of an exemplary LED circuit assembly incorporating a circuit board 45 having a switch 46 and a battery 44. The circuit assembly powers and controls the LED or LEDs and may control flashing, strobe, continuous, multi-color flashing or other effects. In some versions, triggering the switch 46 can control a variety of functions, enabling a user to switch from one function to the next with multiple pushes of the switch.

FIG. 21 is a rear perspective view of the LED circuit assembly having an LED 43, an integrated circuit (IC) 47 for controlling the LED, a battery holder or housing 48 and a battery 44. Although one LED is illustrated, multiple LEDs may be incorporated.

Figure 22A:
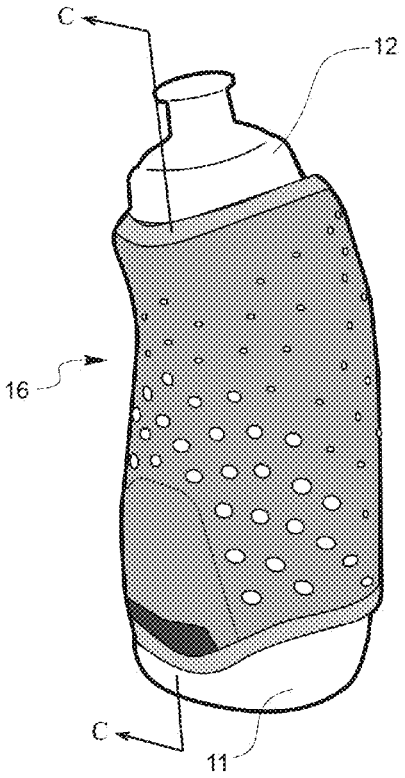
FIG. 22*a* is a front three-quarter perspective view of a preferred embodiment of a bottle and sleeve.
Figure 22B:
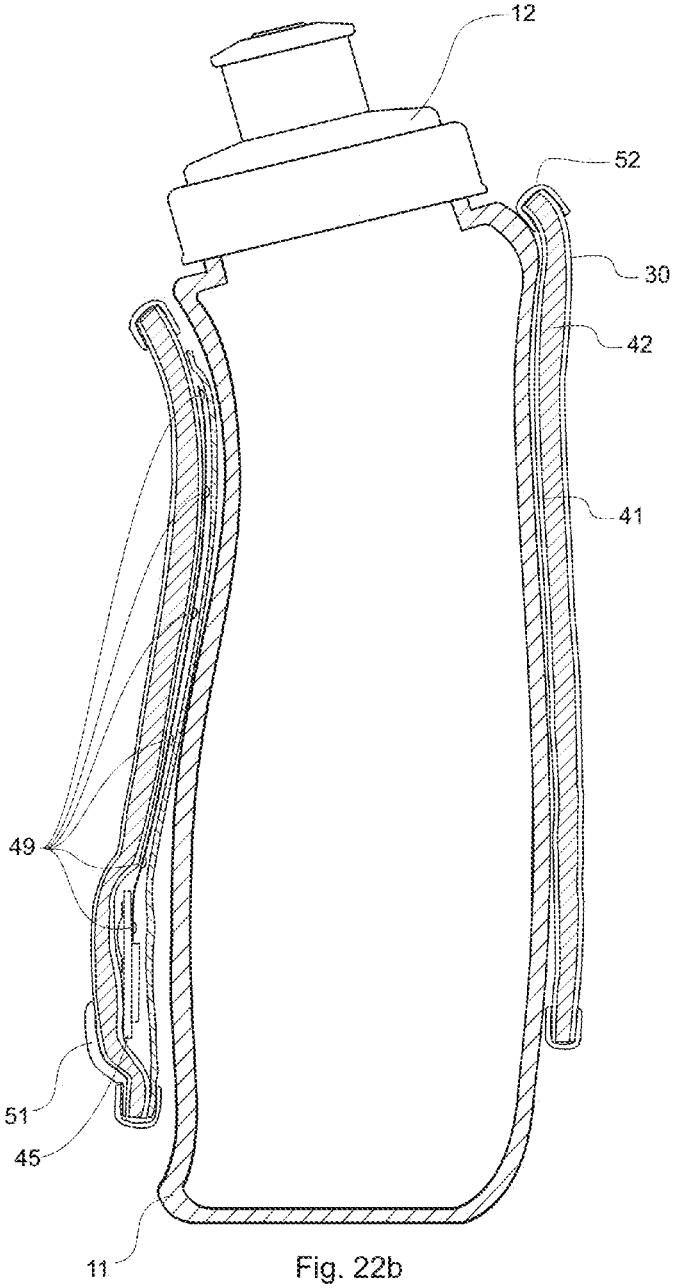
FIG. 22*b* is a sectional view taken through section C-C of FIG. 22*a* showing a light strip having several LEDs 49. This embodiment incorporates preferable circuit board assembly with a length of LED flex strip such that multiple LED locations create a potentially desirable illuminating effect.

FIG. 22*a* is a front three-quarter perspective view of an alternate embodiment of a bottle and sleeve, illustrating a sleeve 16 attached to a bottle 11 having a cap 12. FIG. 22*b* is a section view through section C-C of FIG. 22*a* showing a version having an LED light strip with several LEDs 49. This version incorporates a circuit board assembly 45 or other controller to control the operation of a length of LED flex strip or other structure having multiple LEDs 49 to create an illuminating effect of one or multiple colored, white or multicolored LEDs creating a different effect than a single bulb-style LED. An optional clear window or sleeve may house this circuit and strip. A logo tag 51 is shown at the bottom of the sleeve adjacent the internal circuit board assembly. In the version as illustrated, a base layer 42 includes an interior fabric layer 41 and exterior layer 30, with top and bottom binding.

Figure 27:
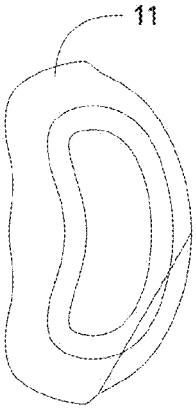
FIG. 27 is a bottom view of the bottle shown in FIG. 23
Figure 25:
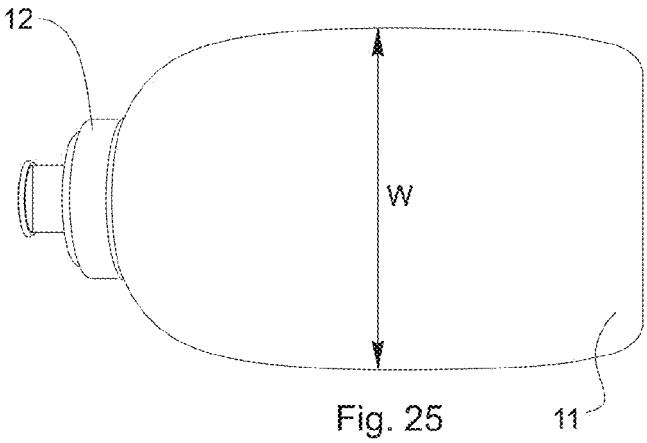
FIG. 25 is a back view of the bottle shown in FIG. 23
Figure 26:
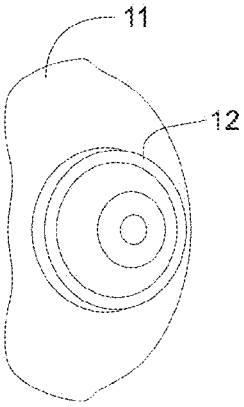
FIG. 26 is a top view of the bottle shown in FIG. 23
Figure 24:
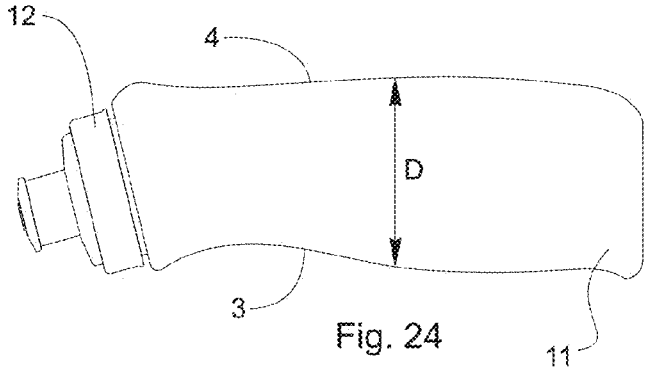
FIG. 24 is a side view of the bottle shown in FIG. 23
Figure 23:
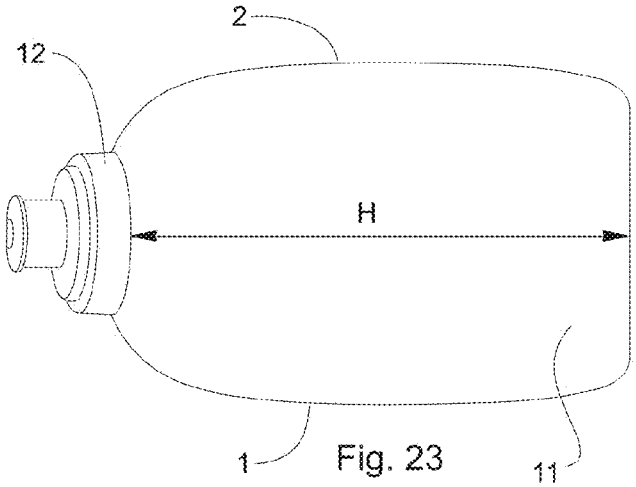
FIG. 23 is a front view of a preferred bottle for use with the preferred sleeve as described, in which the bottle is rotated 90 degrees and resting on a sidewall.

FIG. 23 is a front view of a preferred bottle having a flattened shape for use with this invention. The same bottle is shown in side view in FIG. 24, rear view in FIG. 25, top view in FIG. 26, and bottom view in FIG. 27. The preferred bottle has a height H (see FIG. 23) from the base of the bottle to the neck, a depth D (see FIG. 24) from the front sidewall to the back sidewall), and a width W (see FIG. 25) from a left sidewall to a right sidewall. In the preferred version, the bottle is "flattened" such that at least one of the sidewalls (Most preferably, the one opposite the LED) is relatively flat or planar and is wider than the adjacent sidewalls. In a preferred version, the front and back sidewalls are substantially flat and are wider than the left and right sidewalls, giving the bottle its flattened appearance. In one version the width W is more than 1.5 times the depth D; in another version the width W is more than 2 times the depth D.

The illustrated bottle 11 of FIGS. 23-27 therefore has a first sidewall 1 and an opposing second sidewall 2, a third (or front) sidewall 3 and an opposing fourth (or rear) sidewall 4, the third and fourth sidewalls joining the first and second sidewalls, the first and second sidewalls each being wider than each of the third and fourth sidewalls such as described above. As discussed below, the flattened shape can help to further intensify the lighting effect emanating from the bottle by creating surfaces that reflect the light in a desirable way.

In one version, the interior of the bottle is formed with a shiny or gloss finish, such as can be accomplished with a blow molded bottle using the appropriate materials. In such a version, the interior of the bottle further facilitates the reflecting and scattering of light. The exterior of the bottle can be textured or gloss, although in most cases it is preferable for the exterior of the bottle to have a matte or other texture which can help to diffuse light from the LED(s). It is preferable to have the LEDs positioned opposite a wide sidewall such as the front 3 or rear 4 sidewalls, wherein the light from the LED or LEDs has a prominent flat sidewall to project light back from. See FIG. 28*c*, showing that the sidewall can act as a kind of projection surface providing a broad area to reflect light.

Figure 28A:
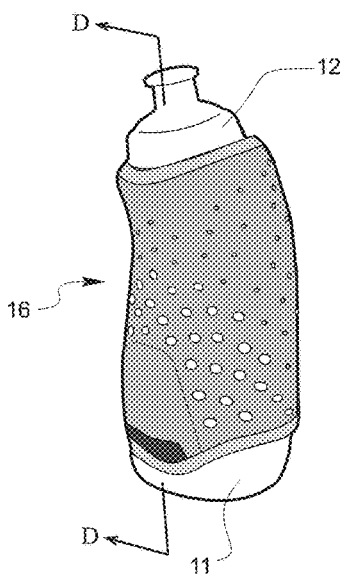
FIG. 28*a* is a front three-quarter perspective view of an alternate embodiment of a bottle and sleeve.
Figure 28B:
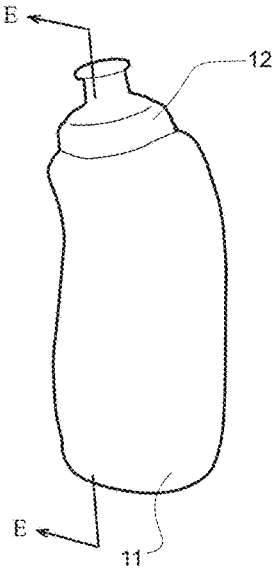
FIG. 28*b* is a front three-quarter perspective view of the bottle of FIG. 28*a*, shown without a sleeve.
Figure 28C:
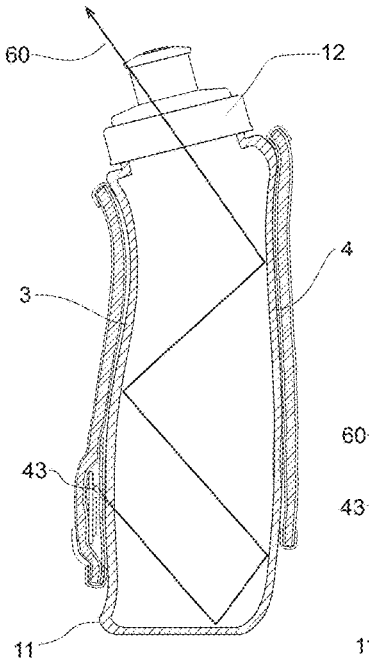
FIG. 28*c* is a section view through section D-D of FIG. 28*a*, showing a preferred position and angle for an LED 43 and a resulting approximate LED light focal scatter path 60. Bottle wall is shown in cross-section although cross hatch lines are not shown for simplicity (as with other views as well).

FIG. 28*c* is a section view through section D-D of FIG. 28*a*, showing a preferred position and angle for an LED 43 having a resulting approximate LED light focal scatter path 60. Generally, LEDs create a point source light and this point source light is focused in a certain direction. In the case of most LEDs, the light is focused in a path straight out from the LEDs. Without some means of diffusing this point source light, an LED has a very bright "hot spot" in its center and the majority of the light emitted from the LED is directed in the direction of the tip of the LED. Because of the geometry of the bottle, the optional use of reflective surfaces, and the placement and focal path of the LED 43, the light is encouraged such that it diffuses this hot spot light source allowing the bottle to have a strong overall glow instead of a localized bright spot or area. This combination creates a diffused glowing bottle much like a lamp with a diffused shade, causing the bottle to appear to be lit up from the inside. This scattering of light effect as illustrated in FIG. 28*c* helps to create a glowing "orb" look. As discussed there are a number of factors that combine to intensify the "glowing orb-like" look such as the use of a white/bright/reflective interior surface of the sleeve, the spacing and pattern of the holes in the sleeve, the angle and position of the LED(s), the translucency of the bottle material, the reflectivity of the inside of the bottle, the size and shape of the internal surface on which light is projected onto, and other factors. As shown in FIG. 28*c* the LED is preferably positioned on one of the two broad surfaces (such as front wall 3) of a flattened bottle and preferably shines generally toward the second broad surface (such as rear wall 4) such that the broad surfaces act as projection/reflection/diffusion surfaces as can be seen in FIG. 28*c*. By directing the LED toward a large flattened wall, the light is more diffused and scattered than would be the case with a typical cylindrical bottle or shining the light toward a similarly shaped sidewall surface.

FIG. 29 is a section view through section D-D of FIG. 28*a* showing an alternate position and angle for an LED 43 producing an alternate LED light focal path 60. In this version, very little scattering is accomplished by such a configuration with the LED focused directly on the back surface.

FIG. 30 is a section view through section D-D of FIG. 28*a* showing an alternate position and angle for an LED 43 producing an alternate LED light focal path 60. The scattering of light is good in this embodiment but less dispersed than the version of FIG. 28*c* because there would be a "hot spot" or "bright area" towards the top of the bottle and the light would n create as good of an "orb" effect as desirable.

Figure 31:
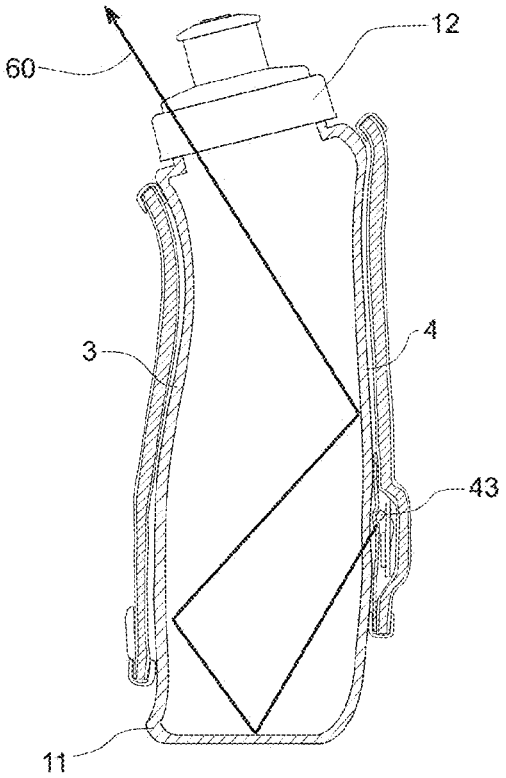
FIG. 31 is a section view through section D-D of FIG. 28*a*, showing an alternate position for an LED 43 and resulting approximate LED light focal scatter path 60. In this version, the LED is placed on the on the side diametrically opposite the hand strap.

FIG. 31 is a section view section FIG. 28*a* showing an alternate position and angle for an LED 43 producing an alternate LED light focal path 60. In this case, the LED circuit assembly is on the opposite side of the bottle as compared with FIG. 28*c*, which is generally a less preferable location from a user perspective because the hand strap is placed on the same side as the LED circuit assembly and a user may find it uncomfortable or awkward for his or her hand to be potentially over top of or next to the circuit assembly.

Figure 32:
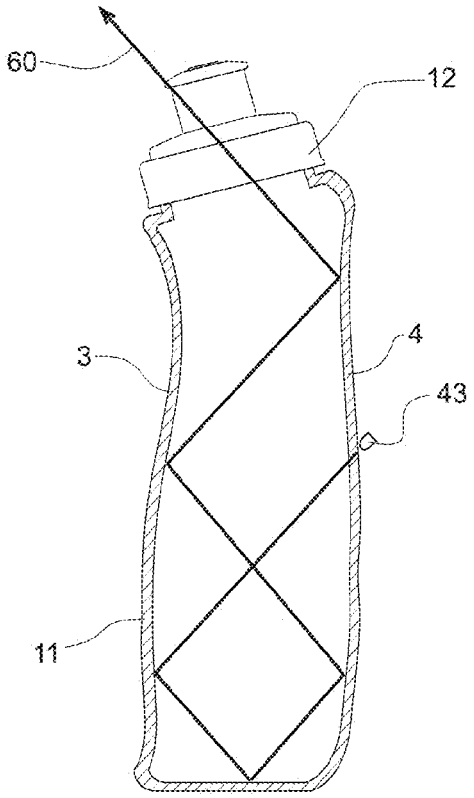
FIG. 32 is a section view through section D-D of FIG. 28*a*, showing an alternate position for an LED 43 and resulting approximate LED light focal scatter path 60.

FIG. 32 is a simplified section view through section E-E of FIG. 28*b* showing an alternate position and angle for an LED 43 producing an alternate LED light focal path 60. This configuration places the LED in a good angle and position to scatter the light, but on a side that may be less desirable as noted with respect to FIG. 31.

Figure 33:
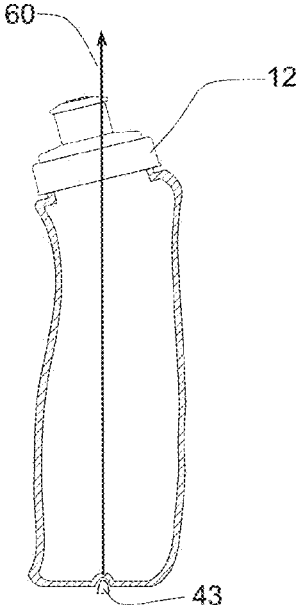
FIG. 33 is a section view through section D-D of FIG. 28*a*, showing an alternate position for an LED 43 and resulting approximate LED light focal scatter path 60.

FIG. 33 is a section view through section E-E of FIG. 28*b* showing an alternate position and angle for an LED 43 producing an alternate LED light focal path 60. FIG. 33 shows how there would be likely very little scattering of light and thus a bright hot spot would be created towards the top of the bottle.

Figure 34:
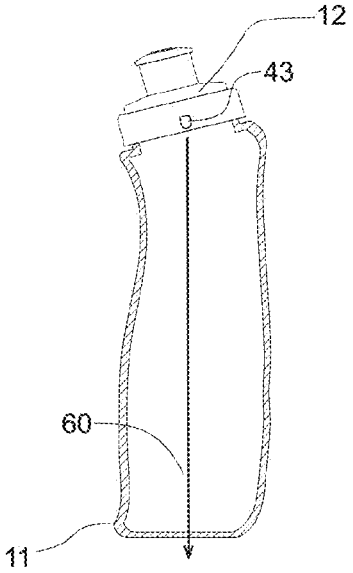
FIG. 34 is a section view through section D-D of FIG. 28*a*, showing an alternate position for an LED 43 and resulting approximate LED light focal scatter path 60. In the version of FIG. 34, the LED circuit assembly would be housed in the cap or on top on the outside of the cap.

FIG. 34 is a section view through section E-E of FIG. 28*b* showing an alternate position and angle for an LED 43 producing an alternate LED light focal path 60. As can be seen from the drawing the LED circuit assembly would be housed in the cap or on top on the outside of the cap which is, in many cases not a preferable location although in some cases for some user requirements it may be desirable to locate the LED in the cap. FIG. 34 shows how there would be likely very little scattering of tight and thus a bright hot spot would be created towards the bottom of the bottle.

Figure 35:
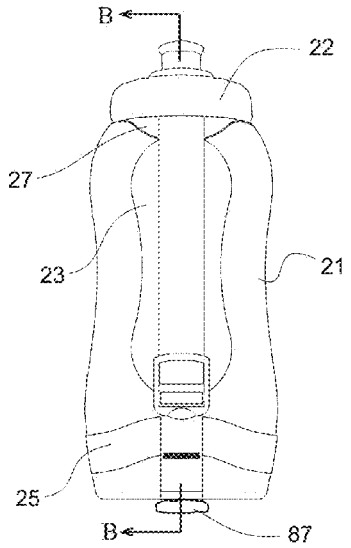
FIG. 35 is a back view of an alternate embodiment of a hand strap combined with a bottle, without an optional sleeve. A preferred LED circuit is mounted beneath the bottle, at the bottom 87.

FIG. 35 is a back view of a hand strap combined with a bottle as shown in the front view of FIG. 3, but in which a sleeve is not shown so that the hand strap can be more simply shown and described.

Figure 36:
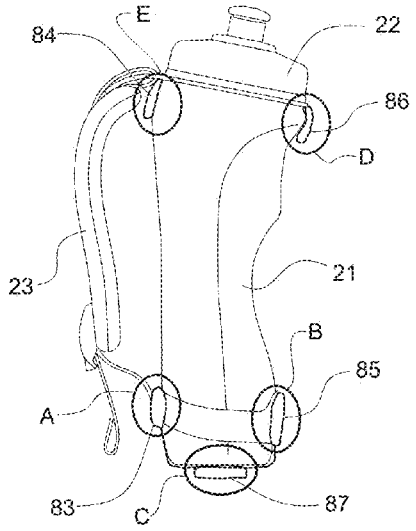
FIG. 36 is side view of the embodiment of FIG. 36, in this case indicating optional areas 83, 84, 85, 86, 87 for LED circuitry as discussed above.

FIG. 36 is side view of the bottle as configured in FIG. 35, again removing a sleeve for either simplicity of illustration or because the embodiment does not use a sleeve. FIG. 36 also illustrates several possible areas 83, 84, 85, 86, 87 for LED circuitry. Most preferably the bottle will include only one LED and accompanying circuit, with the one such LED and circuit occupying one of the indicated areas.

Figure 37:
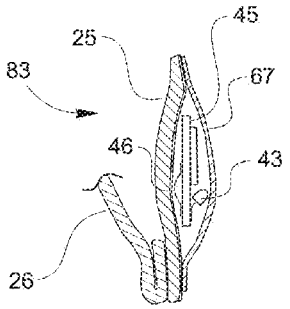
FIG. 37 is a partial sectional view through section B-B of FIG. 35, corresponding to the region of detail A in FIG. 36, showing LED circuitry in area 83 of FIG. 36, in this case incorporated in a housing integrated into the lower hand strap bottle retaining strap. Preferably clear (or, optionally, colored with a translucent colored tint) cover 67 preferably forms a pocket in combination with lower hand strap retaining strap for retaining LED circuitry.

FIG. 37 is a section view through section B-B of FIG. 35 showing location 83, in detail A of FIG. 36. The sidewall of the bottle is not shown, for simplicity of illustration. Preferably clear (or in some cases colored with a translucent colored tint if desired) cover 67 forms a pocket in combination with lower hand strap retaining strap 26 for retaining the LED circuitry, and envelopes the circuit and LED 43. A sleeve is not illustrated, and in one version of the invention the sleeve is not used with the bottle and LED circuit. Instead, in one example as illustrated, the cover 67 is attached to the hand strap to house the circuit and LED. In other cases it may be desirable to have a sleeve in combination with the hand strap wherein the sleeve could help to reflect and diffuse the light.

Figure 38:
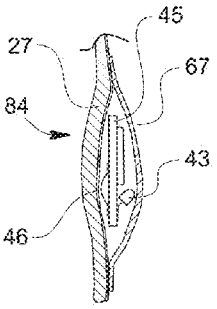
FIG. 38 is a partial sectional view through section B-B of FIG. 35, corresponding to the region of detail A in FIG. 36, showing LED circuitry in area 84 of FIG. 36, in this case incorporated in a housing integrated into the lower hand strap bottle retaining strap. Preferably clear (or, optionally, colored with a translucent colored tint) cover 67 preferably forms a pocket in combination with lower hand strap retaining strap for retaining LED circuitry.

FIG. 38 is a section view through section B-B of FIG. 35 showing location 84, in detail E of FIG. 36. The sidewall of the bottle is not shown, for simplicity of illustration. A cover 67 preferably forms a pocket in combination with lower hand strap retaining strap for retaining the LED circuitry.

Figure 39:
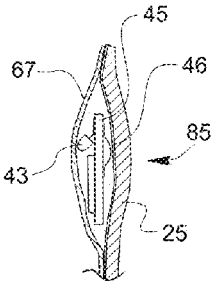
FIG. 39 is a partial sectional view through section B-B of FIG. 35, corresponding to the region of detail B in FIG. 36, showing LED circuitry in area 85 of FIG. 36, in this case incorporated in a housing integrated into the lower hand strap bottle retaining strap. Preferably clear (or, optionally, colored with a translucent colored tint) cover 67 preferably forms a pocket in combination with lower hand strap retaining strap for retaining LED circuitry.

FIG. 39 is a section view through section B-B of FIG. 35 showing location 85, in detail B of FIG. 36. The sidewall of the bottle is not shown, for simplicity of illustration. A cover 67 preferably forms a pocket in combination with lower hand strap retaining strap for retaining LED circuitry.

Figure 40:
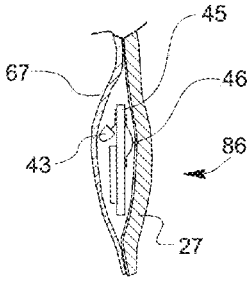
FIG. 40 is a partial sectional view through section B-B of FIG. 35, corresponding to the region of detail B in FIG. 36, showing LED circuitry in area 86 of FIG. 36, in this case incorporated in a housing integrated into the lower hand strap bottle retaining strap. Preferably clear (or, optionally, colored with a translucent colored tint) cover 67 preferably forms a pocket in combination with lower hand strap retaining strap for retaining LED circuitry.

FIG. 40 is a section view through section B-B of FIG. 35 showing location 86, in detail D of FIG. 36. The sidewall of the bottle is not shown, for simplicity of illustration. A cover 67 preferably forms a pocket in combination with lower hand strap retaining strap for retaining LED circuitry.

Figure 41:
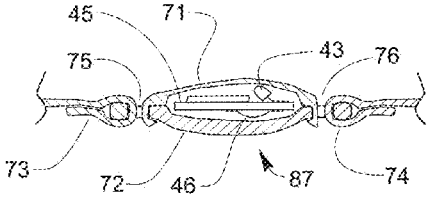
FIG. 41 is a partial sectional view through section B-B of FIG. 35 corresponding to the region of detail C in FIG. 36, showing LED circuitry in area 87 on FIG. 36, in this case incorporated into a housing integrated into the lower hand strap bottle retaining strap. A clear (or in some cases colored with a translucent colored tint if desired) cover 71 forms an enclosure in combination with a button cover 72 (which may be formed as a snap-in cover formed from rubber, silicone rubber, TPE or other materials) wherein this assembly is held in place against the bottle such the LED 43 illuminates the bottle. Ideally, the bottle is formed from somewhat translucent plastic or other materials such that the light from the led can pass through the wall to illuminate the bottle). Optional slots 75 and 76 accept strap ends 73 and 74 which are preferably sewn or otherwise affixed to hold the assembly in place to perform its function to provide illumination to the bottle.

FIG. 41 is a section view through section B-B of FIG. 35 showing location 87, in detail C of FIG. 36. The bottom of the bottle is not shown, for simplicity of illustration. A cover 71 preferably forms an enclosure (for LED 43 and circuitry) in combination with a snap-in rubber, silicone rubber, TPE or other button cover 72. This assembly is preferably held in place against the bottle such that the LED 43 illuminates the bottle. Optional slots 75 and 76 accept strap ends 73 and 74 which are preferably sewn or otherwise affixed to hold the assembly in place.

Figure 42A:
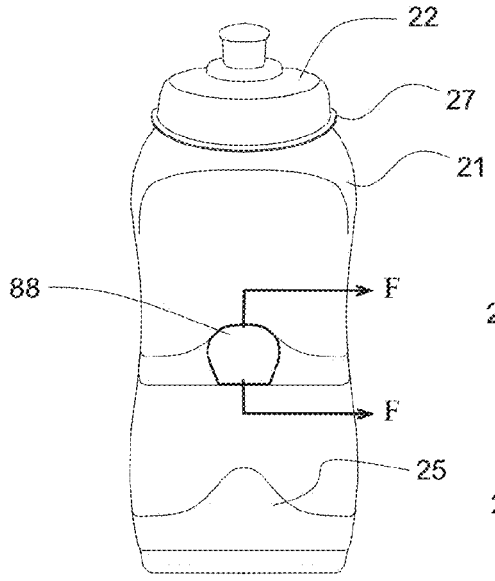
FIG. 42*a* is a front view of an optional embodiment of a hand strap combined with a bottle.
Figure 42B:
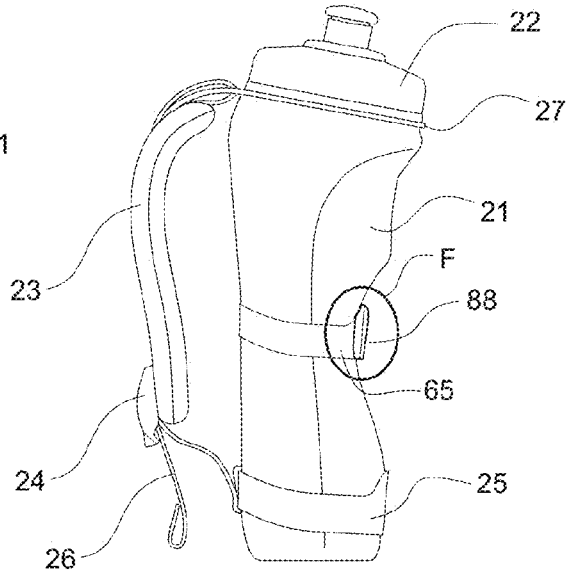
FIG. 42*b* is a side view showing a further optional embodiment of a hand strap combined with a bottle, illustrated without an optional sleeve is not shown. An LED circuit is installed on the bottle at location 88.

FIG. 42*a* is a from view and FIG. 42*b* is side view showing a further embodiment of a hand strap combined with a bottle, such as shown in FIG. 3. In this version, the LED and circuit are mounted at a central bottle location 88, optionally without an accompanying sleeve. A central bottle strap 65 attaches the LED and related components to the bottle, at location 88.

Figure 43:
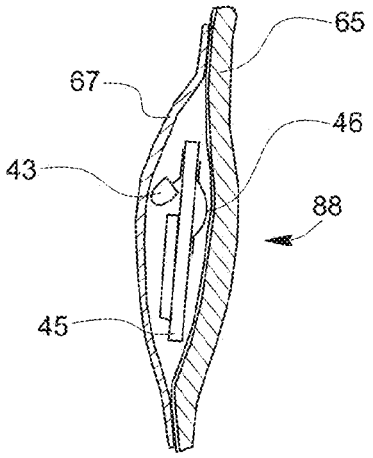
FIG. 43 is a partial sectional view taken through section lines F-F from FIG. 42*a*, corresponding to detail D from FIG. 42*b*, showing location 88 on FIGS. 42*a* and 42*b*, in which an LED circuit housing is integrated into a central bottle strap as shown in FIGS. 42*a* and 42*b*. A clear or tinted cover 67 preferably forms a pocket in combination with central strap retaining strap for retaining LED circuitry.

FIG. 43 is a central section view through section F-F in FIG. 42*a*, showing location 88 in detail F of FIG. 42, in which the LED circuitry housing integrated into a pocket is attached as shown in FIGS. 42*a* and 42*b*. The sidewall of the bottle is not shown, for simplicity of illustration. The purpose of the central bottle strap 65 is to attach the LED and related components to the bottle. A cover 67 forms a pocket in combination with the central strap for retaining LED circuitry 45 and LED 43.

Figure 44:
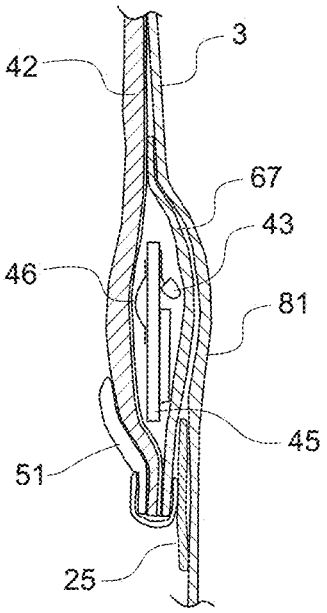
FIG. 44 is a sectional view through section X-X of FIG. 1 showing an optional LED circuit housing integrated into the sleeve. A clear or tinted cover 67 preferably forms a pocket in combination with sleeve for retaining LED circuitry. A wall 81 of the bottle may optionally include a recess formed to accommodate the LED or LED circuitry (and is thereby bulged inward, toward the interior of the bottle). In some cases this bulge acts as a diffuser or lens such that the light emitted by preferable LED 43 is controlled to provide a more desirable visual effect of light diffusion. In some such versions, separate lens or diffuser (that is, formed from different materials than that of the bottle itself) may be incorporated.

FIG. 44 is a section view through section X-X of FIG. 1 showing an LED circuitry housing integrated into a sleeve, including a base layer 42. A lower logo patch 51 is illustrated at the bottom. A gripping strap 25 is shown at a lower portion of the sleeve, for attachment to the bottle as described above. A cover 67 forms a pocket in combination with the sleeve for retaining LED circuitry 45 and LED 43.

The bottle wall (in this case, front wall 3) is illustrated with an optional recess 81 to accommodate the LED circuitry bulge. The "bulge" is an inward cavity or depression, into the interior space of the bottle. In addition, this recess 81 and bulge could act as a diffuser or lens such that the light emitted by the LED 43 is controlled to provide a more desirable visual effect of light diffusion.

Figure 45:
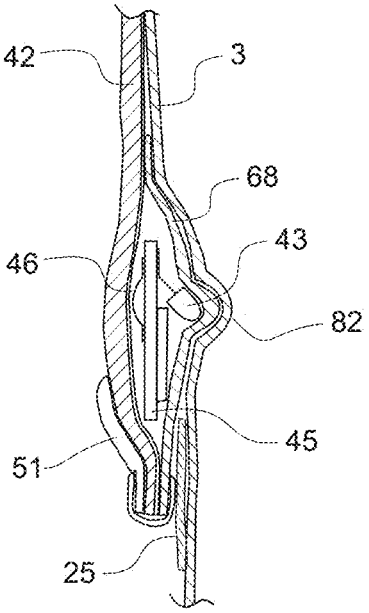
FIG. 45 is a section view through section X-X of FIG. 1 showing another alternate view of the LED circuit and housing, with a bulge in the cover 68 and bottle wall 82 to accommodate the circuit and LED.

FIG. 45 is a section view through section X-X of FIG. 1 showing an LED circuitry housing integrated into a sleeve, including a base layer 42. This version is the same as that of FIG. 44 except that the LED is enlarged and the bulge 82 more closely follows the shape of the LED.

FIG. 46 is a front plan view of an alternate sleeve 94, shown in a flat configuration before it has been joined together along edges 91 and 92 to form a tube or sleeve shape. A plurality of holes 98 are provided through the sleeve 94, producing a desired hole pattern. A silk screened or otherwise applied power symbol is shown, centrally denoting a position on which a user would press to activate a switch to trigger the illuminating function. A stitch line 93 aligns with a mating stitch line 96 (see FIG. 47) on a clear plastic window 95 such that an envelope can be created to house the electronic LED circuitry/battery. In the version of FIG. 46, the location for the pocket (that is, within the boundary of the stitch line 93) for holding circuit assembly is placed more centrally such that a radial pattern of holes can be achieved. FIG. 46 illustrates a desirable hole pattern wherein the larger holes have a space between them at the closest point of a minimum of one hole diameter but more preferable approximately two to three hole diameters and wherein the hole pattern has preferably a minimum of two punched hole diameter sizes (which will stretch and change in diameter when the sleeve is assembled by way of stretching it onto the bottle). As can be seen in FIG. 46, preferably the sleeve has two or more dial hole sizes, the smaller diameter preferably being about half the larger diameter and the spacing between the smaller diameter holes being approximately the same center-to-center as the larger diameter holes.

Figure 47:
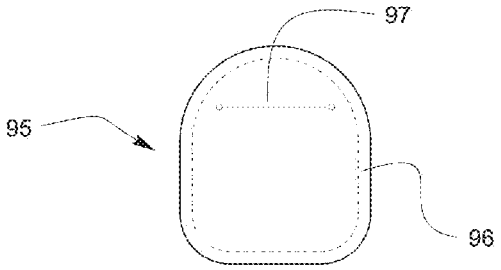
FIG. 47 shows a preferred shape for a translucent window with a slit 97 for a user or assembler to access the electronic LED circuitry and battery, an example of such shown in FIG. 20 and FIG. 21. Window 95 is shaped to mate with sleeve 94 wherein a pocket to house a circuit board is formed by sewing the window and sleeve together, preferably along stitch line 93 (and 96) wherein access to the pocket is through slit 97 such that a preferable circuit board (with battery, LED, switch, chip, etc.) can be inserted and removed such that access is provided to remove, replace, a component held therein.

FIG. 47 shows a preferred shape for a clear window 95 with an optional slit 97 allowing access to the electronic LED circuitry and battery. The window 95 is shaped to mate with the sleeve 94 herein a pocket to house a circuit board is formed by joining the window to the sleeve (by stitching or otherwise), preferably along stitch lines 93 and 96, allowing access to the pocket through slit 97.

Although the preferred sleeve has the electronic circuitry and battery stored within it, in some cases it may be desirable to house the circuit and battery in a portion of the hand strap or other enclosure, with a wire or flex strip connecting the lighting element (LED for example) and the battery or circuit. For example the embodiment shown in FIG. 1 and FIG. 2 may house the circuit or battery in the pocket of the hand strap (or in the hand strap of the embodiment shown in FIG. 3-7). Further a button may be placed in this hand strap area such that the power switch could be actuated by pressing a portion of the hand strap.

In accordance with other preferred versions of the invention, the bottle and sleeve sleeve can be mounted on a belt, pack, bag, strap, or other device where ready-access to a bottle is desirable.

In versions of the invention where stitching has been described for attaching the window, the attachment can alternatively be accomplished with heat sealing or ultrasonic welding.

Although the window preferably includes a slot 39 for accessing the battery and electronic circuit, access to this area can be provided in other ways such as with a folded-over flap, sandwich bag-style connection or other ziplock or the like closures.

The sleeve is preferably constructed by sewing a generally flat panel of neoprene or other material together. The sleeve can alternatively be constructed by knitting, gluing, integrally forming or otherwise fastening parts together that have been manufactured from a variety of processes and techniques. Some other optional fabrics for the sleeve include leather, felt, waterproof/water resistant fabric, or breathable/punched fabric. Sleeve parts can be constructed in a number fabrics of different materials, and can be formed or cut using other techniques. For example various parts of the invention could be combined, molded as one, woven, heat sealed together, ultrasonically bonded together or formed in other ways.

Although the description above contains many specificities, these should not be construed as limiting the scope of the invention but as merely providing illustrations of some of the presently preferred embodiments of this invention. The embodiments detailed in the figures and described herein can be combined in a variety of manners with varying success.

The embodiments of the invention in which an exclusive property or privilege is claimed are defined as follows:

1. A sleeve for a bottle, comprising:

a base layer of a first flexible material forming the sleeve, the sleeve having an interior surface and an exterior surface, whereby the sleeve is attachable to the bottle such that the interior surface faces toward the bottle;

a reflective layer attached to the base layer and covering at least a portion of the interior surface;

a light source carried on the sleeve, the light source being directed toward the bottle when the sleeve is attached around the bottle; and one or more holes formed in the base layer, whereby light emitted from the light source and reflected by the bottle is allowed to pass through the one or more holes when the sleeve is attached around the bottle;

wherein the bottle further comprises opposing first and second sidewalls and third and fourth sidewalls, the third and fourth sidewalls being positioned between the first and second sidewalls, and further wherein the light source is positioned adjacent the third sidewall when the sleeve is attached to the bottle, having a depth D from the third sidewall to the fourth sidewall which is less than a width W from the first sidewall to the second sidewall.

2. The sleeve of claim 1, wherein the reflective layer is formed from a fabric material.

3. The sleeve of claim 2, wherein the base layer is formed from neoprene.

4. The sleeve of claim 2, wherein the light source is a light emitting diode.

5. The sleeve of claim 4, wherein the one or more holes comprises a plurality of holes forming a hole pattern.

6. The sleeve of claim 5, wherein the sleeve defines an upper end and a lower end, the lower end being relatively adjacent to a base of the bottle when the sleeve is attached to the bottle, and further wherein the light emitting diode is attached to and positioned within the sleeve between the upper end and the lower end to direct light emitted from the light emitting diode primarily toward the lower end and away from the upper end of the sleeve.

7. The sleeve of claim 6, wherein the light emitting diode is directed toward the interior of the bottle and downward at an angle of 45 degrees when the sleeve is attached to the bottle.

8. The sleeve of claim 7, wherein the pocket further comprises a translucent cover, the cover being positioned adjacent the bottle when the sleeve is attached to the bottle.

9. The sleeve of claim 1, wherein the reflective layer is formed from a second flexible material.

10. The sleeve of claim 1, further comprising a pocket formed in the sleeve, wherein the light source is positioned within the pocket.

11. The sleeve of claim 1, further a power switch in communication with the light source and operable to selectively turn the light source on and off, the power switch being positioned between the sleeve and the bottle when the sleeve is attached to the bottle.

12. A sleeve, comprising:

a base layer of material forming the sleeve, the sleeve having an interior surface and an exterior surface, whereby the sleeve forms a tubular shape having an open top end and an open bottom end and an interior space within the tubular shape formed by the sleeve;

a light source carried on the sleeve and positioned between the open top end and the open bottom end, the light source being oriented to direct the majority of the light emitted from the light source toward the interior space, wherein the light source is a light emitting diode;

one or more holes formed in the base layer, whereby light emitted from the light source and directed toward the interior space is allowed to pass through the one or more holes when the light is illuminated; and a bottle having a bottom and a top forming an opening, the sleeve and the bottle being sized and configured such that the bottle is snugly receivable within the sleeve, the bottle further having opposing first and second sidewalls and third and fourth sidewalls, the third and fourth sidewalls being positioned between the first and second sidewalls, and further wherein the light source is positioned adjacent the third sidewall when the sleeve is attached to the bottle, having a depth D from the third sidewall to the fourth sidewall which is less than a width W from the first sidewall to the second sidewall.

13. The sleeve of claim 12, wherein the interior surface is reflective.

14. The sleeve of claim 12, wherein the one or more holes comprises a plurality of holes.

15. The sleeve of claim 12, wherein the light emitting diode is positioned within the sleeve between the bottom and the top to direct light emitted from the light emitting diode primarily toward the bottom of the bottle when the bottle is received within the sleeve.

16. The sleeve of claim 15, wherein the light emitting diode is directed toward the interior of the bottle and downward at an angle of 45 degrees when the bottle is received within the sleeve.

17. The sleeve of claim 12, further comprising a pocket formed in the sleeve, wherein the light source is positioned within the pocket.

18. The sleeve of claim 17, wherein the pocket further comprises a translucent cover, the cover being positioned adjacent the bottle when the sleeve is attached to the bottle.

19. The sleeve of claim 12, wherein the third sidewall further comprises a bulge directed toward an interior of the bottle, the light emitting diode being seated in the bulge when the sleeve is attached to the bottle.

20. The sleeve of claim 12, wherein bottle further comprises a sidewall extending upwardly from the bottom toward the top, the sidewall further comprising a bulge directed toward an interior of the bottle, the light emitting diode being seated in the bulge when the sleeve is attached to the bottle.

21. The sleeve of claim 20, further a power switch in communication with the light source and operable to selectively turn the light source on and off, the power switch being positioned between the sleeve and the bottle when the sleeve is attached to the bottle.

22. The sleeve of claim 12, further comprising a hand strap attached to the sleeve.

* * * * *